United States Patent [19]

Berg

[11] Patent Number: 4,875,267

[45] Date of Patent: Oct. 24, 1989

[54] MEANS FOR ASSEMBLING BOARDS

[76] Inventor: Olle Berg, Dåderman, Järna, Sweden

[21] Appl. No.: 213,613

[22] PCT Filed: Dec. 22, 1986

[86] PCT No.: PCT/SE86/00584

§ 371 Date: Jun. 27, 1988

§ 102(e) Date: Jun. 27, 1988

[87] PCT Pub. No.: WO87/04286

PCT Pub. Date: Jul. 16, 1987

[30] Foreign Application Priority Data

Dec. 27, 1985 [SE] Sweden ..... 8506135-6

[51] Int. Cl.[4] ..... B23P 11/00

[52] U.S. Cl. ..... 29/281.3; 269/910

[58] Field of Search ..... 269/40, 43, 303, 910; 100/913; 29/281.1, 281.3; 227/152, 154, 155

[56] References Cited

U.S. PATENT DOCUMENTS

| | | | |
|---|---|---|---|
| 2,305,124 | 12/1942 | Wilson et al. | 269/910 |
| 2,811,186 | 10/1957 | Honza | 269/910 |
| 3,299,920 | 1/1967 | Koenigshof | 269/910 |
| 4,154,436 | 5/1979 | Sellers | 269/910 |
| 4,541,618 | 9/1985 | Bruno | 269/41 |

FOREIGN PATENT DOCUMENTS

| | | |
|---|---|---|
| 357085 | 6/1973 | SE . |
| 372641 | 12/1974 | SE . |
| 372643 | 12/1974 | SE . |
| 372643 | 12/1974 | SE . |
| 3002965 | 8/1980 | DE . |
| 1121157 | 4/1982 | CA . |

*Primary Examiner*—Robert C. Watson
*Attorney, Agent, or Firm*—Nixon & Vanderhye

[57] ABSTRACT

For assembling display boards of varying, predetermined sizes, and of the type comprising two sign element holders (1, 2) determining the height of the display board, one or more back elements (3, 4) determining the width of the display board and arranged to be rigidly connected to flat outer surfaces (5) of the sign element holders (1, 2), and sign elements which are inserted into corresponding grooves in the sign element holders, said holders having substantially L or J shaped cross section with a shank (8) and a foot portion (9), the invention proposes a fixture comprising a flat plate (14) which is somewhat larger than the largest predetermined size of the display boards and which has a plurality of parallel grooves (19 to 26) to receive the foot portions (99) of the sign element holders (1, 2) without friction or play, the grooves (19 to 26) being arranged in a coordinate system with a first groove (19) located on the y-axis and the remaining grooves (20 to 26) being arranged with predetermined distances from the first groove with increasing x-values corresponding to predetermined widths of display boards. The grooves (19 to 26) start from the x-axis with which one end of a sign element holder (1, 2) placed in a groove is to coincide during assembly, and the grooves (19 to 26) are sufficiently long to receive sign element holders (1, 2) of varying lengths corresponding to predetermined heights of display boards.

9 Claims, 2 Drawing Sheets

MEANS FOR ASSEMBLING BOARDS

The present invention relates to a means for assembling rectangular display boards of varying, predetermined sizes, and of the type comprising two sign element holders determining the height of the display board, one or more back elements determining the width of the display board and arranged to be rigidly connected to flat outer surfaces of the sign element holders, and sign elements the end portions of which being arranged to be inserted into corresponding grooves in the sign element holders, said holders having substantially L or J shaped cross section with a shank and a foot portion protruding therefrom.

The manufacture of display boards of the type described above has hitherto been extremely time-consuming and complicated, requiring large quantities of material and considerable expense. Even if measurements are taken with great accuracy when assembling the various parts, it is difficult to achieve the desired exactitude with respect to the parts. The back elements must be the same size as the intended display board and, for practical reasons, cannot be kept in stock for all sizes of display boards. They must therefore be measured and cut from larger plates. Both material consumption and waste are thereby high. It has therefore been impossible to save material as desired and to stock complete sets of the various parts.

The object of the present invention is to eliminate the above-mentioned drawbacks and to provide a means enabling display boards of the type described to be assembled quickly and simply while saving both material and expense.

The means according to the invention is essentially characterised by a fixture comprising a flat plate which is somewhat larger than the largest predetermined size of the display boards and which has a plurality of parallel grooves to receive the foot portions of the sign element holders without friction or play, the grooves being arranged in a coordinate system with a first groove located on the y-axis and the remaining grooves being arranged with predetermined distances from the first groove with increasing x-values corresponding to predetermined widths of display boards, and the grooves starting from the x-axis with which one end of a sign element holder placed in a groove is to coincide during assembly, said grooves being sufficiently long to receive sign element holders of varying lengths corresponding to predetermined heights of display boards.

According to a preferred embodiment of the means according to the invention, said grooves are formed in support ribs which are rigidly connected to the plate serving as base. A stop element is suitably mounted at the ends of the support ribs located closest to the operator in order to close, with respect to the plate, the lower end part of the groove of the sign element holder, and, with respect to the plate, the upper end part of the groove of the sign element holder is free for insertion of an angle-shaped back element having a support element intended to retain said sign elements in the finished display board.

The invention will be described further in the following with reference to the accompanying drawings.

Figure 1:
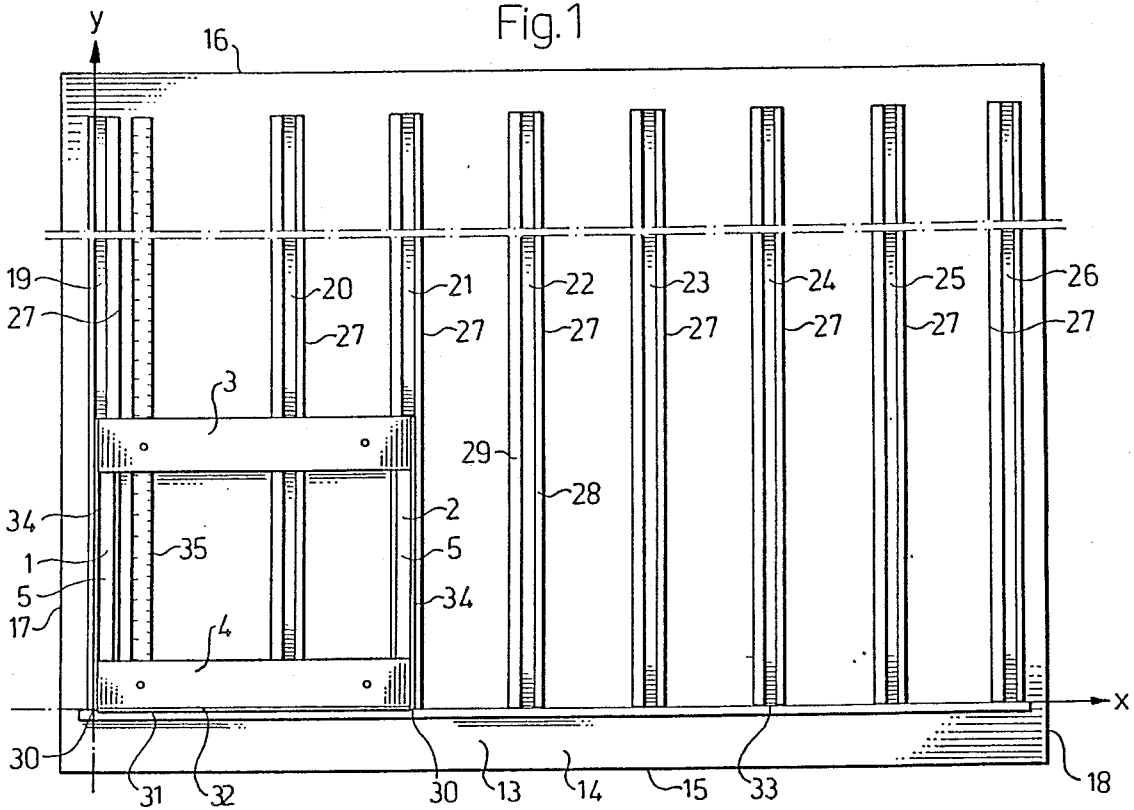
FIG. 1 is a plan view of a means according to the invention, with two sign element holders and back elements in positions for assembly.
Figure 2:
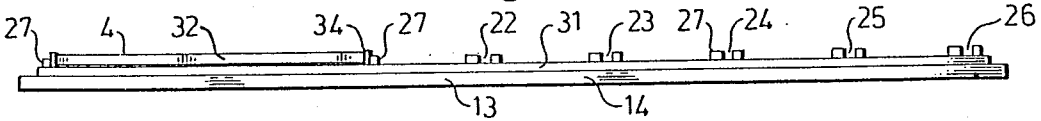
FIG. 2 is an end view of the means according to FIG. 1.
Figure 3:
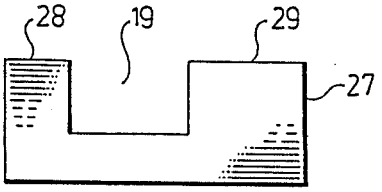
FIG. 3 is an end view of a support rib of the means according to FIG. 1.
Figure 4:
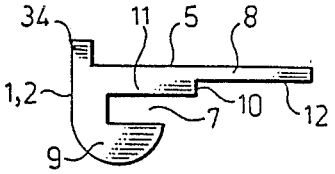
FIG. 4 is an end view of a sign element holder.
Figure 5:
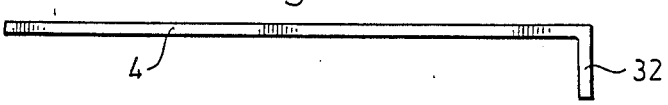
FIG. 5 is an end view of a back-piece.
Figure 6:
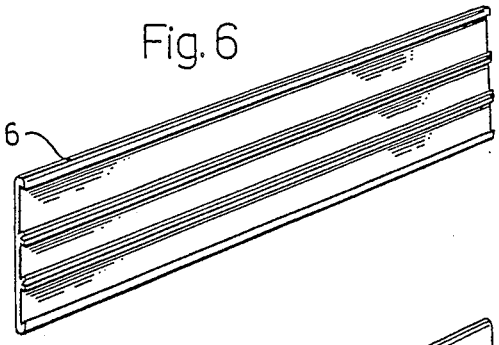
FIGS. 6 to 8 show a sign element which may be included in a display board of the type described.
Figure 7:
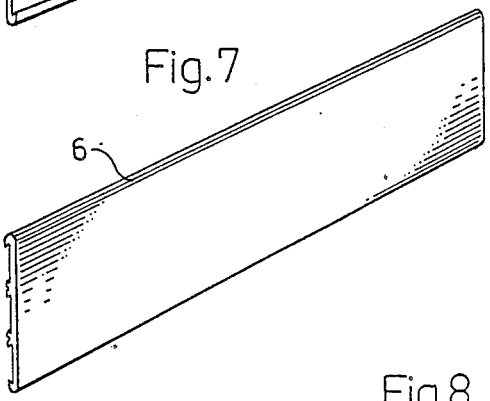
Figure 8:
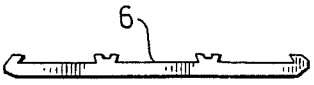

With reference to FIGS. 1 and 2 it is shown therein a preferred embodiment of the means according to the present invention for assembling rectangular display boards of varying, predetermined sizes. The display boards are of the type comprising two sign element holders 1, 2 of the same length and shape which determine the height of the display board, one or more back elements 3, 4 determining the width of the display board and arranged to be rigidly connected, preferably by means of double-sided adhesive tape, to flat outer surfaces 5 of the sign element holders 1, 2, and reversible, grooved sign elements 6 (FIGS. 6 to 8), their end portions being arranged to be inserted in corresponding grooves 7 (FIG. 4) of the sign element holders 1, 2 secured by the back elements 3, 4. The cross section of the sign element holders is substantially L or J shaped, with a shank 8 and a foot portion 9 extending from the shank, which is thus bent backwards in the direction of the shank 8 in order to form said groove 7 (FIG. 4). The shank 8 is provided with a shoulder 10 facing the foot portion 9, which gives the sign element holder a portion 11 of predetermined thickness. The inner surface 12 of the shank, extending from the shoulder 10 serves as a contact surface, as will be explained further below. Each sign element holder is also provided with a side wall 34 extending perpendicularly to the shank 8 in connection to the foot portion 9. The side wall 34 forms a demarcation in order to hide the ends of the back elements 3, 4 and serves also as a support and alignment means for the back elements 3, 4 when these are to be placed onto two sign element holders 1, 2. The distance between two inserted side walls 34 corresponds to the length or slightly less than the length of a back-piece.

In accordance with the present invention the means shown in FIG. 1 consists of a fixture 13 comprising a sturdy plate 14 of entirely flat, rectangular shape with predetermined dimensions, i.e. it is somewhat larger than the largest predetermined size of the display boards. The plate 14 has a lower edge 15, an upper edge 16 and two side edges 17, 18, the operator normally being located close to said lower edge when assembling the display board.

The plate 14 is provided with a plurality of parallel grooves 19, 20, 21, 22, 23, 24, 25, 26 to receive the foot portions 9 of the sign element holders 1, 2 without friction and play. Each groove has a width adapted to the width of the sign element holders 1, 2, so that the portion 11 of the sign element holder is received in the groove without friction or play, the depth of the groove corresponding to the height of the foot portion 9 measured from the surface 12.

In the preferred embodiment shown the grooves 19 to 26 are formed in specific support ribs 27 which are rigidly connected to the plate 14, by means of double-sided adhesive tape, for instance. The support ribs 27 are parallel to the side edges 17, 18 and the upper surface of each is divided into a smaller surface 28 and a larger surface 29 in that the grooves 19 to 26 are somewhat displaced from the centre. The larger surface 29 of the support rib 27 located nearest to the side edge 17 is located nearest the other support ribs, whereas the larger surface 29 of the other support ribs 27 is located nearest said first support rib. The larger surface 29 is at least as large as the inner surface 12 of the shank 8 so as to offer suitable contact when a sign element holder 1, 2 is inserted into a groove 19 to 26.

The grooves 19 to 26 are arranged in a coordinate system (more specifically a right-angled parallel coordinate system) with a first groove 19 forming or coinciding with the y-axis and the remaining grooves 20 to 26 being arranged at predetermined distances from the first groove 19, i.e. the y-axis, with increasing x-values which correspond to the predetermined widths of the display boards. The grooves 19 to 26 start from the x-axis with which one end 30 of a sign element holder is to coincide during the assembly. The first groove 19 thus starts at the origin of the coordinates. In the embodiment shown a stop element 31 is mounted along the ends 33 of the support ribs 27, one side surface of the stop element thus abutting these ends and therefore being located in or coinciding with the x-axis. The stop element 31 thus closes at least, with respect to the plate 14, the lower end part of the groove 19 to 26 at the end 33 of the support rib 27, providing a stop against which the sign element holders 1, 2 are placed so that their correct starting positions are achieved quickly and immediately to form a rectangle, without any time-consuming adjustment or fitting in being necessary. The lower back element 4 is suitably provided with an angle-shaped support element 32 which, when the display board is being assembled, is brought into abutment against the ends 33 of the support ribs 27 and thus also against the ends 30 of the two sign element holders 1, 2 so that the grooves 7 in the holders are closed. The sign elements 6 subsequently inserted (after removal of the frame 1, 2, 3, 4 from the fixture 13) into grooves 7 are thereby retained by this support element 32. It will be understood that the height of the fixed stop element 31 is such as to allow clearance between itself and the angle-shaped support element 32 during assembly.

The support ribs 27, and thus grooves 19 to 26 have a sufficient predetermined length to receive sign element holders 1, 2 of varying lengths corresponding to the predetermined heights of display boards.

In the embodiment shown a rule 35 is rigidly mounted onto the plate 14 inside and in the vicinity of the first support rib 27, thus enabling the various heights of display boards to be quickly ascertained on the rule.

A number of essential advantages are gained by using the means according to the invention. The rear part of the display board can be built up of one or more relatively narrow back elements instead of a single back element. This enables the use of back elements of uniform width. They can therefore be stocked only in different lengths, corresponding to the number of predetermined x-values (representing the various lengths of the display boards). This offers a considerable saving in material and consequently a considerable reduction in costs. Each display board can be assembled extremely quickly and simply in comparison with earlier methods and all parts can be stocked in various predetermined lengths corresponding to the number of pre-determined x and y-values, close to the assembling place. The desired exactitude and fit are obtained immediately without requiring extra measurement and adjustment. Furthermore, an unskilled person can quickly learn to use the fixture and assemble finished display boards free of objections. Risks of errors in assembly are eliminated since the sign element holders can be placed in exact positions determined by grooves in the fixture.

The simple construction of the display boards out of a few easily assembable parts and easily dismantable and reversible sign elements provides a display system with numerous possibilities of applications hitherto impossible with earlier assembly technique. The fixture according to the invention now offers real bases for the display system to be used to a far greater extent than previously.

In an alternative embodiment of the fixture, the grooves are cut directly in the plate by milling, for instance.

I claim:

1. A means for assembling rectangular display boards of varying, predetermined sizes, and of the type comprising two sign element holders (1, 2) determining the height of the display board, one or more back elements (3, 4) determining the width of the display board and arranged to be rigidly connected to flat outer surfaces (5) of the sign element holders (1, 2), and sign elements the end portions of which being arranged to be inserted into corresponding grooves in the sign element holders, said holders having a shank (8) with a foot portion (9) protruding from the shank, said assembling means comprising: a static fixture comprising a plate (14) which is larger than the largest predetermined size of the display boards to be assembled, and which has means defining a plurality of parallel grooves (19 to 26) to receive the foot portions (9) of the sign element holders (1, 2) without friction or play, the grooves (19 to 26) being arranged in a coordinate system with a first groove (19) located on the y-axis and the remaining grooves (20 to 26) being arranged with predetermined distances from the first groove with increasing x-values corresponding to predetermined widths of display boards, and the grooves (19 to 26) starting from the x-axis with which one end of a sign element holder (1, 2) placed in a groove is to coincide during assembly, said grooves (19 to 26) being sufficiently long to receive sign element holders (1, 2) of varying lengths corresponding to predetermined heights of display boards.

2. A means according to claim 1, wherein the means for defining grooves (19 to 26) comprise support ribs (27) which are rigidly connected to the plate (14).

3. A means according to claim 2, further comprising a stop element (31) mounted at the ends of the support ribs (27) located closest to the operator in order to close, with respect to the plate, the lower end part of the groove (7) of the sign element holder (1, 2), and, with respect to the plate, the upper end part of the groove (7) of the sign element holder (1, 2) is free for the insertion of an angle-shaped back element having a support element (32) intended to retain said sign elements in the finished display board.

4. A means according to claim 2 further comprising a stop element rigidly mounted on the plate extending upwardly therefrom and closing off the bottom portions of each of said grooves at one end of said support ribs, said stop element defining the x-axis of said static fixture.

5. A means according to claim 4 wherein each of said support ribs comprises an upper surface and which said grooves are provided, said upper surface having a first portion on one side of a groove, and a second portion on the other side of the groove, the first portion being larger than the second portion so that the groove is located off-center in the rib.

6. A means according to claim 5 wherein said ribs are connected to the plate by double-sided adhesive tape.

7. A means according to claim 2 wherein each of said support ribs comprises an upper surface and which said grooves are provided, said upper surface having a first portion on one side of a groove, and a second portion on the other side of the groove, the first portion being larger than the second portion so that the groove is located off-center in the rib.

8. A means according to claim 2 wherein said ribs are connected to the plate by double-sided adhesive tape.

9. A means according to claim 1 further comprising a stop element rigidly connected to said plate and defining said x-axis, said stop element preventing movement of sign element holders in said grooves out of said grooves passed said stop element.

* * * * *